US006626123B1

(12) United States Patent
MacKarvich

(10) Patent No.: US 6,626,123 B1
(45) Date of Patent: Sep. 30, 2003

(54) BI-METAL, LIGHT WEIGHT SELF PENETRATING BOAT ANCHOR

(76) Inventor: Charles J. MacKarvich, 3940 Paces Manor Dr., Atlanta, GA (US) 30339

( * ) Notice: Subject to any disclaimer, the term of this patent is extended or adjusted under 35 U.S.C. 154(b) by 0 days.

(21) Appl. No.: 10/145,830

(22) Filed: May 14, 2002

(51) Int. Cl.[7] ..... B63B 21/38
(52) U.S. Cl. ..... 114/304
(58) Field of Search ..... 114/294, 295, 114/301, 304, 309

(56) References Cited

U.S. PATENT DOCUMENTS

| | | | | |
|---|---|---|---|---|
| 3,030,907 A | | 4/1962 | Rosselle | 114/208 |
| 3,269,348 A | | 8/1966 | Churchward | 114/208 |
| 3,757,727 A | | 9/1973 | Hungerford | 114/208 |
| 3,822,665 A | * | 7/1974 | Hungerford | 114/310 |
| 4,073,256 A | | 2/1978 | Rossini | 114/306 |
| 4,676,184 A | | 6/1987 | Ogg | 114/304 |
| 4,926,779 A | | 5/1990 | Piton et al. | 114/297 |
| 5,154,133 A | * | 10/1992 | Hallerberg | 114/303 |

* cited by examiner

*Primary Examiner*—Stephen Avila
(74) *Attorney, Agent, or Firm*—Thomas, Kayden, Horstemeyer & Risley

(57) ABSTRACT

A bi-metal light weight self penetrating boat anchor includes flukes 18A and 18B and a crown 16 formed of light weight material, such as aluminum, and includes a shank 12 and stock 14 formed of heavier material such as stainless steel. The heavier shank assures that the shank will lie flat on the lake bottom when being dragged by the boat, and the stronger heavier stock resists bending or other deterioration when engaging obstacles at the lake bottom. The reduced weight of the crown and flukes permits the anchor to be of reasonable weight that is more conveniently handled by the boat operator.

5 Claims, 3 Drawing Sheets

BI-METAL, LIGHT WEIGHT SELF PENETRATING BOAT ANCHOR

FIELD OF THE INVENTION

This invention relates to a self penetrating boat anchor for engaging the bottom beneath a lake or other body of water and which penetrates the bottom in response to being dragged by the boat. More particularly, the invention involves a self penetrating boat anchor having flukes that pivot with respect to the shank to permit the flukes to dig into the lake bottom when the anchor is dragged, when either side of the anchor is in engagement with the lake bottom.

BACKGROUND OF THE INVENTION

Boat anchors are formed in various configurations for the purpose engaging the bottom beneath the body of water so that the anchor can hold itself to the bottom while it's anchor chain and line extend latterly and upwardly to the surface of the water and hold a boat or other floating object in a relatively stationary position.

One of the more popular styles of boat anchors is the Danforth anchor that is relatively lightweight for its size, and is useful for anchoring small boats. The anchor has a shank connected at one of its ends to an anchor chain, the other end of the shank is pivotally connected to a stock and a pair of flukes. The stock extends normal to the shank, and the flukes straddle the shank and are connected to the stock so that their pointed ends can pivot with respect to the shank and penetrate the lake bottom. When the anchor chain attempts to drag the anchor along the lake bottom, the flukes can pivot with respect to the stock, to extend at a downwardly sloped angle that causes them to penetrate the surface of the lake bottom, thereby holding to the bottom. This tends to terminate the lateral movement of the anchor, thereby restraining the movement of the boat or other floating objects at the surface of the water.

The anchors are made so that the pair of flukes that straddle the shank are rigidly connected to each other by a common stock. The stock extends laterally at the base of the shank and flukes, and the stock is pivotally connected to the shank. With this arrangement, the anchor can fall from the boat to the lake bottom, and then tilt in either direction until it's shank lies flat upon the lake bottom, and the flukes will have the opportunity to form an angle with respect to the shank, to extend downwardly into the lake bottom as the shank is being pulled across the lake bottom by the boat.

The prior art self penetrating boat anchors must be much heavier than the weight of water so as to the sink to the bottom of the lake and to resist upward lifting forces that might be caused by movement of the water. It is important that the shank of an anchor be of high specific gravity so that it will tend to lie flat upon the lake bottom even in response to being dragged by the boat to which it is tether. If the shank is of lightweight, low specific gravity construction it will be more likely to tilt upwardly as it is being dragged by the boat, so that it's flukes will have less opportunity to engage and penetrate the lake bottom.

Likewise, the shank must be of very strong material so that it can withstand the various forces applied to it by the boat dragging the anchor or forcing the anchor into the lake bottom, and to resist deterioration from various obstructions that might be encountered at the lake bottom.

Likewise, the stock of the boat anchor must be of very strong material so as to resist the forces applied to it under the same circumstances as the shank, and also being able to penetrate that lake bottom. The use of ferrous material for both the shank and the stock is desired for strength and weight purposes, so that the stock and shank can be of relatively small cross sectional area for the ability to penetrate the lake bottom.

In addition, the prior art has taught the use of ferrous materials, such as stainless steel, for use in all parts of a self-penetrating boat anchor, including the flukes, the crown, and the aforesaid elements. This provides the anchor with adequate weight and strength to perform its desired functions.

While the prior art anchors have been successful in function, there is a problem with the weight of an anchor particularly when the anchor is being handled at the level of the boat, by lifting the anchor out of the water for placement in the boat or lifting the anchor out of the boat for placement in the water. Obviously, the heavier and more massive the anchor, the better holding power it achieves with respect to the lake bottom, but the more difficult it is handle by the personnel in the boat, and the excessive weight of the anchor, together with it's shape, is hazardous to the boat with regard to marring scarring, or even rupturing the deck and/or bulk heads of the boat.

Applicant addresses the above noted problems by providing a bi-metal, lightweight self-penetrating boat anchor that utilizes different metals for different parts of the anchor.

SUMMARY OF THE INVENTION

Briefly described, the present invention provides a bi-metal, light weight self penetrating boat anchor for use with boats in which the anchor, it's chain and line are expected to be handled manually, and in which the light weight of the anchor is desirable when the anchor is being man handled.

The anchor includes the conventional shank that is pivotal with respect to the stock, flukes and crown of the anchor. The flukes, stock and crown are assembled so as to be rigidly attached to one another, whereas the shank is pivotal with respect to these elements, to extend at an acute angle to either side of the flukes. In the embodiment of the invention illustrated, the crown limits the pivotal movement of the flukes, with respect to the shank to an angle of 35° to either side of the shank. This angle can be increased or decreased as might be desired by reshaping the crown of the anchor, but must be limited to less than a right angle for proper penetration into the lake bottom.

The flukes of the anchor are substantially flat, with a strengthening rib of each fluke facing the shank. The flukes are necessarily broad so as to be able to engage the lake bottom with sufficient cross sectional area so as to perform their anchoring functions. Thus, the volume of material embodied in the flukes usually is greater than the volume of material embodied in the other elements of the anchor assembly.

Likewise, the crown that functions to raise the pivotal ends of the flukes away from the lake bottom so that the pointed distal ends can penetrate the lake bottom comprises a mass of material of sufficient volume. However, it is not necessary that either the flukes or the crown be fabricated of heavier metals because of the manner in which they function on the lake bottom. In contrast, however, the shank and the stock must be made of very strong and dense materials so that the weights and strengths of these parts are used in the function of an anchor. For example, the shank must be heavy in order to lie parallel to the surface of the lake bottom, thereby giving the flukes the opportunity to droop from their pivoted ends to their pointed distal ends toward engagement with the lake bottom. When the anchor is dragged by it's chain and line extending to the boat, the heavy shank tends to remain flat on the lake bottom until the boat is almost over the anchor and the anchor is lifted upwardly toward the boat. This gives the flukes and opportunity to penetrate the lake bottom. Likewise, the stock must be of strong material so as to withstand the forces normally applied to it when being dragged through the lake bottom or into engagement with obstructions with on the lake bottom. Moreover, both the shank and stock should be of relatively thin profile so that they also can penetrate the lake bottom in response to their movements imparted by the boat attempting to drag the anchor.

However, the flukes and crown of the invention that should be formed with more cross sectional surface area are fabricated of lighter weight material than the stock and shank, such as Aluminum, Magnesium or Titanium. This allows the anchor to be lighter in weight while retaining more mass in the stock and shank where it is important to retain the weight.

Thus, it is the object of this invention to provide an improved a self penetrating boat anchor of light weight that function adequately to anchor a boat or other floating objects, yet is of lighter than conventional weight for ease and handling and storing.

Another object of this invention is to provide a self penetrating boat anchor that includes parts thereof that are of dense, heavy metals that utilizes the weight of the metals for enhancing the functions of an anchor, and utilizes lighter weight metals in those parts of the anchor that do not require the parts to be of heavy weight for proper functioning of the anchor.

Other objects, features and advantages of the present invention will become apparent upon reading the following specification, when taken in conjunction with the accompany drawing.

DETAILED DESCRIPTION

Figure 1:
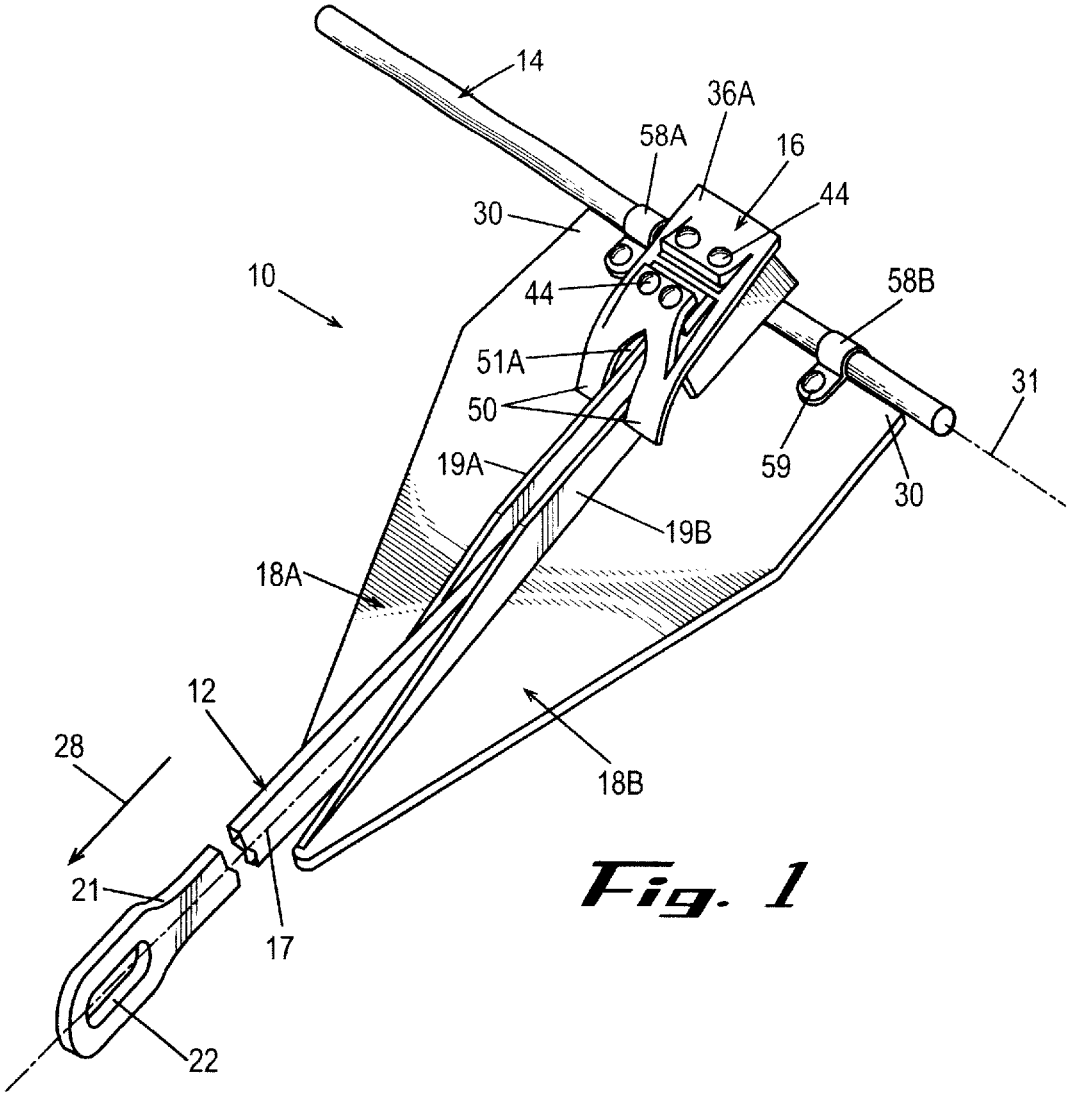
FIG. 1 is prospective illustration of a lightweight self-penetrating boat anchor.

Referring now in more detail to the drawings, in which like numerals indicate like parts throughout the several views, FIG. 1 illustrates the boat anchor 10 that includes a shank 12, a stock 14, a crown 16 and a pair of flukes 18A and 18B. The flukes straddle the shank 12.

Figure 5:
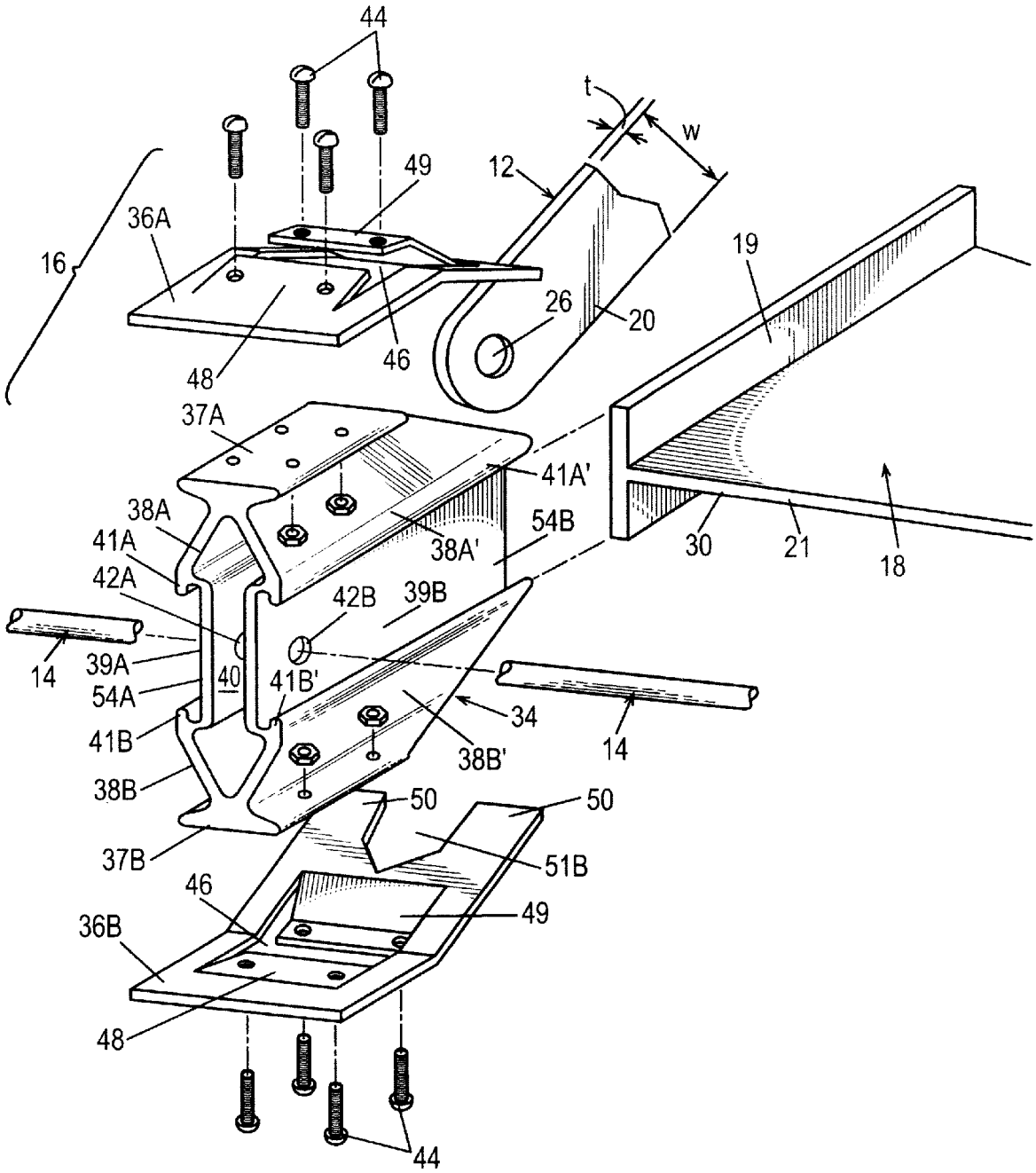
FIG. 5 is an exploded prospected illustration of the crown of the boat anchor, showing portions of the stock, shank, and flukes.

Shank 12 is a rectilinear, substantially flat strap that has a length or longitudinal axis 17 and that includes a pivotal, proximal end 20 (FIG. 5) and a distal end 21. The distal end of the shank is formed with a slot 22 for connection to one end of an anchor 24 chain (FIG. 2) and a line (not shown) is connected to the other end of the anchor chain. The pivotal or proximal end 20 of the shank defines a stock opening 26 for engagement with the stock 14, for surrounding the stock.

The shape of the shank 12 is important so that the shank can penetrate the lake bottom. The thickness "t" (FIG. 5) is less than one fifth the dimension of the width "w", so that the flat or greater dimension w of the shank normally is maintained perpendicular to the lake bottom and does not present a broad engagement with lake bottom. Whereas the smaller dimension t is orientated so that it will engage the lake bottom (FIG. 2) and the shank will therefore have a better opportunity to penetrate the lake bottom as it is pulled by the anchor chain, line and boat in the direction indicated by arrow 28.

To assist in the penetration of the stock into the lake bottom, the chain 24 is made of iron which is dense and therefore heavy, tending to avoid lifting of the distal end of the stock in response to upward sloped lifting of the line extending from the chain to the boat.

Stock 14 is rectilinear having a length or axis 31 and is circular in cross section and defines a slot 29 (FIG. 2) that is sized and shaped to receive the proximal ends 30 of the flukes 18A and 18B. The stock 14 extends through the stock opening 26 of the shank 12, and protrudes on opposite sides of the shank, with it's length 31 extending normal to the length 17 of the shank 12.

Figure 3:
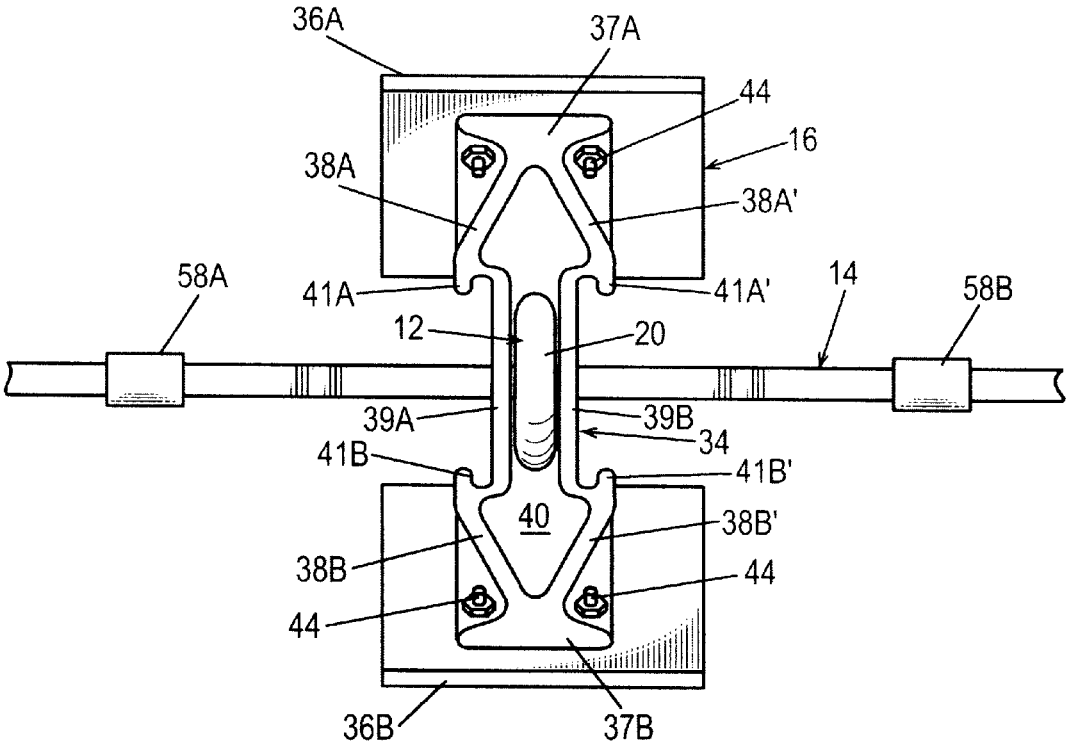
FIG. 3 is a rear view of the crown of the boat anchor, showing the stock extending through the crown and the pivotal end of the shank.
Figure 4:
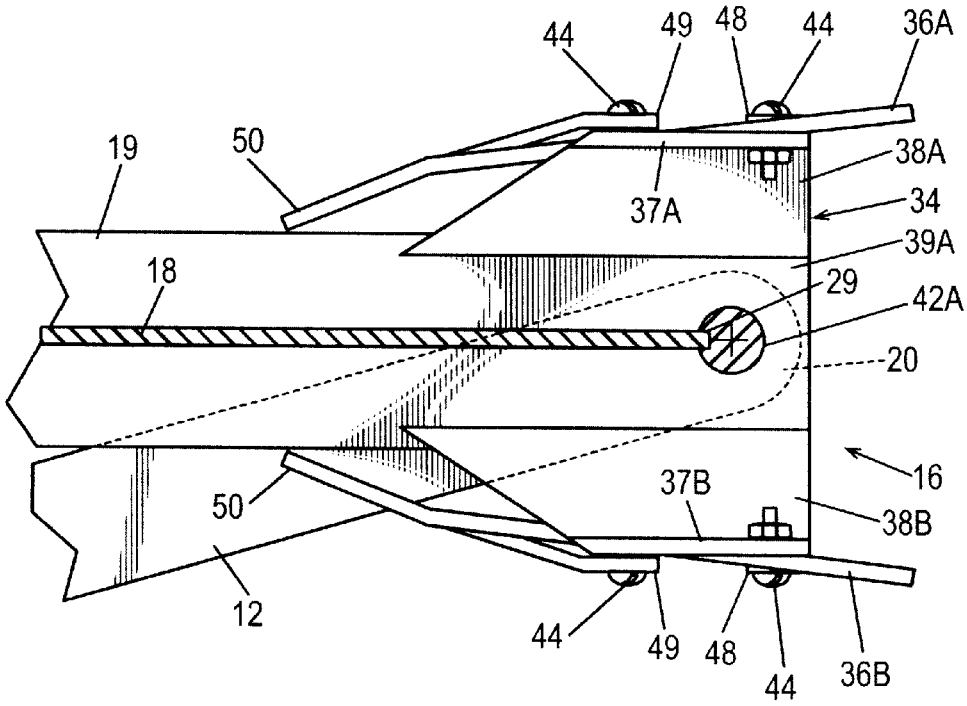
FIG. 4 is a side view of the crown of the boat anchor, showing a fluke and the shank partially in cross section.

Crown 16 includes a support frame 34 (FIGS. 3–5) and limiting plates 36A and 36B. Crown support frame 34 is formed by extrusion and is cut to length and shape as necessary for its use. As can be seen from FIGS. 3 and 5, the extrusion includes opposed support platforms 37A and 37B, diverging base walls 38A and 38A' and 38B and 38B', parallel support walls 39A and 39B. The diverging base walls and parallel support walls define a central cavity 40 that receives the pivotal end 20 of shank 12. The stock opening 26 of the shank 12 aligns with the aligned stock openings 42A and 42B of the crown support frame 34, and the stock 14 is inserted through the aligned openings thereby pivotally connecting the stock 12 to the crown 16.

Limiting plates 36A and 36B are mounted to the opposed support platforms 37A and 37B by connector screws 44. The limiting plates are formed with a center cutout 46 (FIG. 5) and formed support tabs 48 and 49. The support tabs 48 and 49 are shaped so as to mount to flat against the support platforms 37A and 37B of the crown support frame 34. This allows the limiting plates to be sloped with respect to the surfaces of the opposed support platforms 37A and 37B. The distal edges 50 of the limiting plates 36A and 36B are formed with notches 51A and 51B. The notches register with the opposite edges of the shank 12 when the shank is tilted with respect to the flukes 18.

Figure 2:
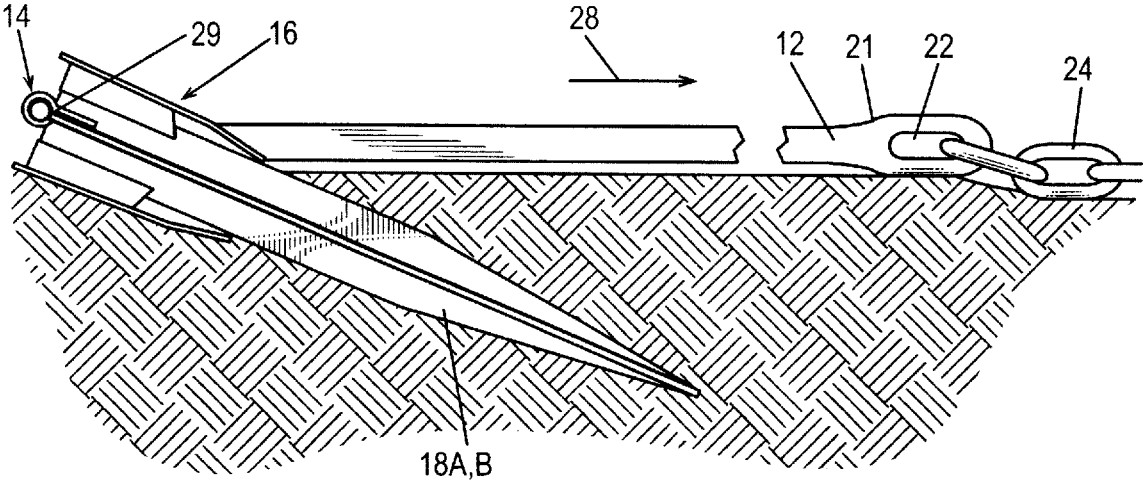
FIG. 2 is a side view of the boat anchor of FIG. 1 in its configuration when the boat is dragging the boat anchor and its flukes are penetrating the lake bottom.

The parallel support walls 39A and 39B of the crown support frame 34, together with the overhanging portions 41A, 41A', and 41B, 41B' of the diverging base walls 38A, 38A', and 38B, 38B' form an oppositely facing "C" shaped slots 54A and 54B. The slots 54A and 54B are used to receive the strengthening flanges 19 of the flukes 18, by sliding each strengthening flange into a "C" shape notch. When the flukes have been fully slide into the "C" shape notches, the proximal or base ends 21 of the flukes will be received in correspondingly sized and shapes slots 29 of the stock 14 (FIG. 2). Retaining clamps 58A and 58B surround stock 14 and fasten by means of bolts 59 to the flukes 18A and 18B.

As can be seen from FIG. 2, shank 12 pivots with respect to the flukes 18A, 18B, the crown 16 and the stock 14.

The flukes 18A and 18B are of sufficient cross sectional area and require a substantial amount of material to form the desired cross sectional area. Flukes 18A and 18B are fabricated of lightweight metal, such as aluminum, magnesium, or titanium.

Likewise, the elements of crown 16 are formed of lightweight material, such as aluminum, magnesium, or titanium.

Shank 12 and stock 14 are made of more dense heavier material that is stronger and requires less volume of material to achieve the desired strength. Shank 12 and stock 14 are made of ferrous material, such as stainless steel which includes the strength and density desired.

The heavier weight of the shank 12 is utilized in the function of the anchor, by the weight causing the shank to lie flat against and penetrate the surface of the lake bottom, as illustrated in FIG. 2. To enhance this flat position of the shank 12, a chain 24 typically is used so that it's weight resists the upward lifting force that it is normally applied by the movement of a boat while dragging the anchor.

The stock 14 is also made of heavy metal, such as stainless steel, for similar purposes, so that it can resist bending or breaking when ensnared with obstructions on the lake bottom or when being dragged through the lake bottom. However, the lightweight material of the crown and flukes is not required for the above noted functions. The flukes, being of broad configuration, adequately engage the material of the lake bottom without having to be of heavy material. The sharp distal ends of the flukes are adequate in penetrating the lake bottom, and once the penetration is made, the lake bottom tends to draw the flukes deeper into the soil or other materials below the surface of the lake bottom. In the mean time, the crown 16 functions to hold the proximal, pivotal end of the flukes above the surface of the lake bottom so that the sharper distal ends of the flukes have the opportunity to form an angle with respect to the lake bottom for penetration purposes. Weight is not essential to the operation of the crown. However, the flukes must be heavier than water so they will not tend to float in water and the crown should be heavier than water so as to avoid the anchor losing some of its relative weight with respect to water at the crown.

The combination of the heavier material for the shank and stock of the anchor, together with the lighter weight material for the crown and flukes provides a combination that accomplishes the desired function of the anchor when on the lake bottom yet avoids excessive weight of the anchor when being handled at the surface of the water or in the boat.

Although preferred embodiments of the invention have been disclosed in detail herein, it will be obvious to those skilled in the art that variations and modifications of the disclosed embodiments can be made without departing from the spirit and scope of the invention as set forth in the following claims.

Therefore, having thus described the invention, at least the following is claimed:

1. A self penetrating boat anchor for engaging the bottom beneath a body of water and restraining movement of a boat, comprising:

an elongated shank having a pivot end and a distal end, an elongated stock having opposed ends and connected intermediate its ends to said pivot end of said shank with its length extending normal to the length of said shank, a pair of flukes straddling said shank, said flukes each including a proximal end connected to said stock and a distal end for penetrating the bottom beneath a body of water, a crown mounted to said proximal ends of said flukes and extending about said pivotal end of said shank, said crown, flukes and stock being rigidly connected to one another and pivotally connected to said shank, said crown shaped to limit the pivoting of said shank to acute angles to either side of said flukes, the improvement therein of:

said shank and stock composed of ferrous material, and said flukes and crown composed of a metal selected from the group consisting essentially of aluminum, titanium, and magnesium, whereby the mass of the shank and stock is greater than the mass of the flukes and crown, and the overall weight of the anchor is less than a duplicate anchor having all of its components composed of ferrous material.

2. The penetrating boat anchor of claim 1, wherein said flukes are formed of sheet aluminum and include a strengthening rib.

3. The penetrating boat anchor of claim 1, wherein said distal ends of said flukes are pointed for penetrating the bottom surface of the body of water.

4. The penetrating boat anchor of claim 1, wherein said shank has a width at least five times greater than its thickness for enhancing the ability of said distal end of said shank to engage the bottom beneath a body of water.

5. A penetrating boat anchor for engaging the bottom beneath a body of water and restraining movement of a boat, comprising:

an elongated shank having a pivot end and a distal end, said shank being of a width five times greater than its thickness for enhancing penetrating the bottom beneath a body of water an elongated stock having opposed ends and connected intermediate its ends to said pivot end of said shank with its length extending normal to the length of said shank, a pair of flukes straddling said shank, said flukes each including a proximal end connected to said stock and a pointed distal end for penetrating the bottom beneath a body of water, a crown mounted to said proximal ends of said flukes and extending about said pivotal end of said shank, said flukes being pivotally connected to said shank, the improvement therein of:

said shank composed of ferrous material, and said flukes and crown composed of a metal selected from materials of less density than ferrous metal, from the group consisting essentially of aluminum, titanium, and magnesium, whereby the mass of the shank is greater than the mass of the flukes and crown, and the overall weight of the anchor is less than a duplicate anchor having all of its components composed of ferrous material.

* * * * *